United States Patent [19]

Koromilas

[11] Patent Number: 4,841,930

[45] Date of Patent: Jun. 27, 1989

[54] POSITIVE DISPLACEMENT ROTARY MECHANISM

[75] Inventor: Constantinos A. Koromilas, Utica, Mich.

[73] Assignee: General Motors Corporation, Detroit, Mich.

[21] Appl. No.: 222,867

[22] Filed: Jul. 22, 1988

Related U.S. Application Data

[62] Division of Ser. No. 5,077, Jan. 20, 1987, Pat. No. 4,782,802.

[51] Int. Cl.[4] ..... F02B 53/00

[52] U.S. Cl. ..... 123/246; 123/204; 123/238; 418/197

[58] Field of Search ..... 123/204, 238, 249; 418/197, 201

[56] References Cited

U.S. PATENT DOCUMENTS

| | | | |
|---|---|---|---|
| 2,410,341 | 10/1946 | Delamere | 418/197 |
| 2,652,192 | 9/1953 | Chilton | 418/197 X |
| 3,966,371 | 6/1976 | Berzanske | 418/197 |

FOREIGN PATENT DOCUMENTS

| | | | |
|---|---|---|---|
| 2367185 | 5/1978 | France | 418/197 |
| 285412 | 5/1931 | Italy | 418/197 |
| 287462 | 7/1931 | Italy | 418/197 |
| 160515 | 9/1983 | Japan | 123/238 |
| 93979 | 12/1938 | Sweden | 418/197 |
| 889246 | 2/1962 | United Kingdom | 123/204 |

*Primary Examiner*—Michael Koczo
*Attorney, Agent, or Firm*—R. L. Phillips

[57] ABSTRACT

A positive displacement rotary mechanism has three identical rotary helical intermeshing lobes that cooperate with a stationary cylindrical member extending centrally thereof to define a repetitive working space internal of the lobes having boundaries along and between the lobes and along and between the lobes and the cylindrical member which boundaries move on rotation of the lobes to effect expansion and contraction of the working space while repetitively moving same from one of the ends of the lobes toward their other end.

2 Claims, 6 Drawing Sheets

POSITIVE DISPLACEMENT ROTARY MECHANISM

This is a division of copending application Ser. No. 005,077, filed Jan. 20, 1987, U.S. Pat. No. 4,782,802.

TECHNICAL FIELD

This invention relates to positive displacement rotary mechanisms and more particularly to those with a plurality of rotary lobes forming a compressor or vacuum pump or combustion engine.

BACKGROUND OF THE INVENTION

In the typical positive displacement rotary mechanism having two or more rotary lobes forming a compressor or vacuum pump or combustion engine, the lobes have surfaces paralleling the lobe axes and require the additional cooperation of either a surrounding housing to form the expansible and contractible working space (chamber) or intake and exhaust porting and valving in or on the lobes to communicate with the working space where the lobes independently define the outer periphery of the working space. Moreover, such prior mechanisms typically produce not more than one complete working cycle per lobe revolution.

SUMMARY OF THE INVENTION

An object of the present invention is to eliminate the need for any such housing or porting and valving and increase cycle rate by expanding the function of the lobes. This is accomplished by employing either three or four identical rotary intermeshing helical lobes with parallel axes and identical helical surfaces extending between opposite ends thereof. The helical surfaces have a varying or changing pitch and a cross sectional profile as viewed axially having convex circular apexes joined by either two or three convex circular sides such that the helical surfaces cooperate through close line-to-line relationship therebetween and also with a stationary cylindrical member extending centrally of the lobes to define repetitive expansible and contractible working spaces internal of the lobes having boundaries along and between the lobes and along and between the lobes and the cylindrical member that move on rotation of the lobes to effect expansion and contraction of the working spaces while moving same from one end of the lobes to their other end. In the case of a compressor or vacuum pump, the helical surfaces of the lobes are provided with a continuously varying or two constant pitches that expand and contract the working spaces with the central cylindrical member serving to form the inner boundary of such spaces and also access an exhaust passage therefrom. In the case of an internal combustion engine, the helical surfaces are provided with an additional continuously varying or constant pitch to provide additional expansion after compression to extract work. In the latter case, the stationary member in addition to forming the inner boundary of the working spaces also provides for accessing an ignition system with the working spaces following compression and also possibly fuel where such is not introduced externally with the air during intake expansion.

DETAILED DESCRIPTION OF PREFERRED EMBODIMENTS

These and other objects, advantages and features of the present invention will become more apparent from the following description and accompanying drawings wherein.

Figure 1:
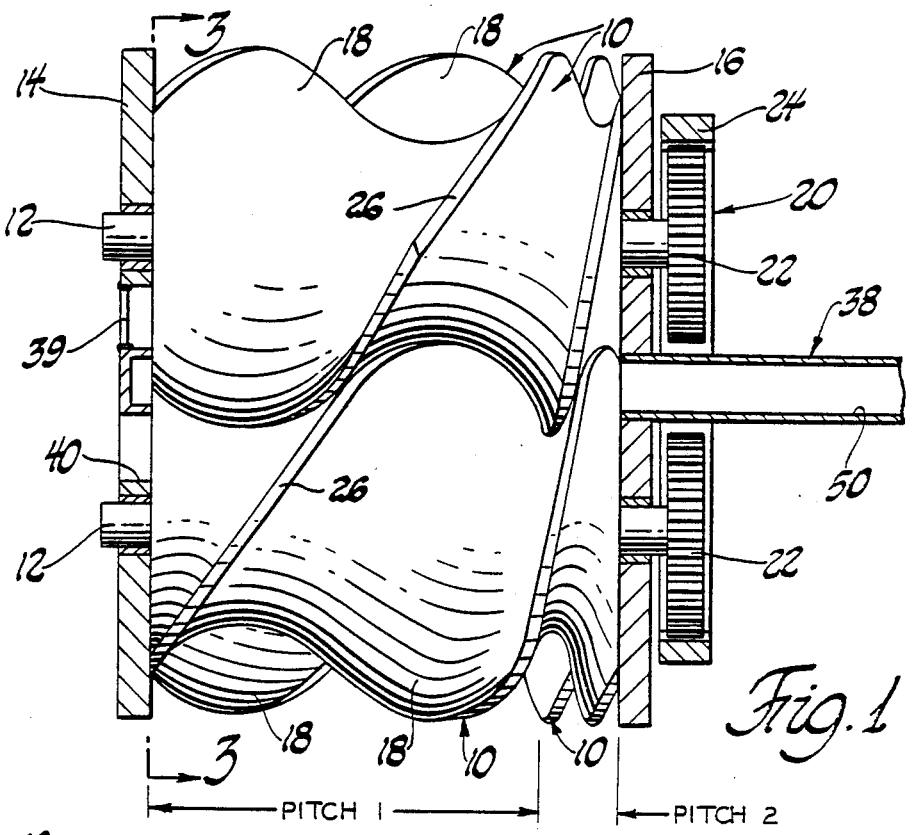
FIG. 1 is a diagrammatic side view with some parts in section of a four helical lobe compressor according to the present invention.

FIGS. 5(*a*) through 5(*i*) are schematic axial views illustrating the full cycle of the four lobes of the compressor in FIG. 1.

Figure 6:
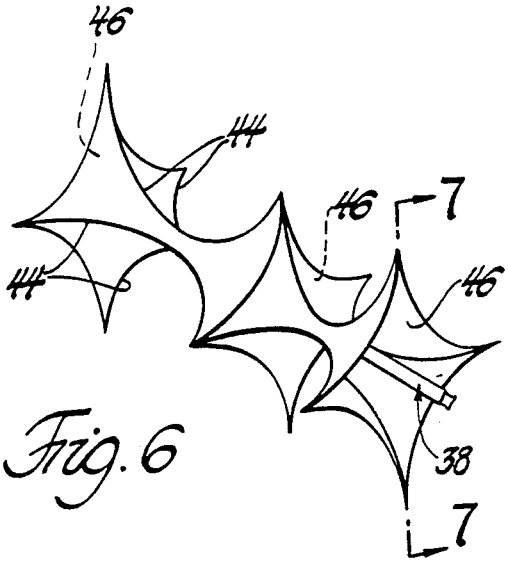

FIG. 6 is a three-dimensional diagrammatic representation of the moving boundaries of the working spaces in the compressor in FIG. 1.

Figure 7:
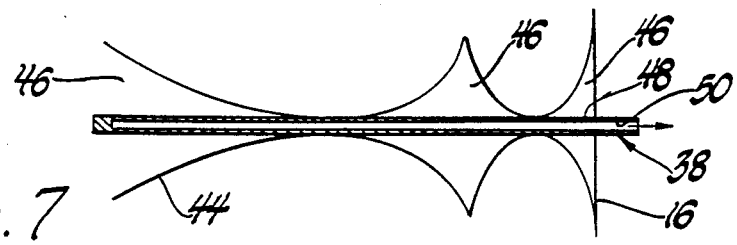

FIG. 7 is a view taken along the line 7—7 in FIG. 6.

Figure 8:
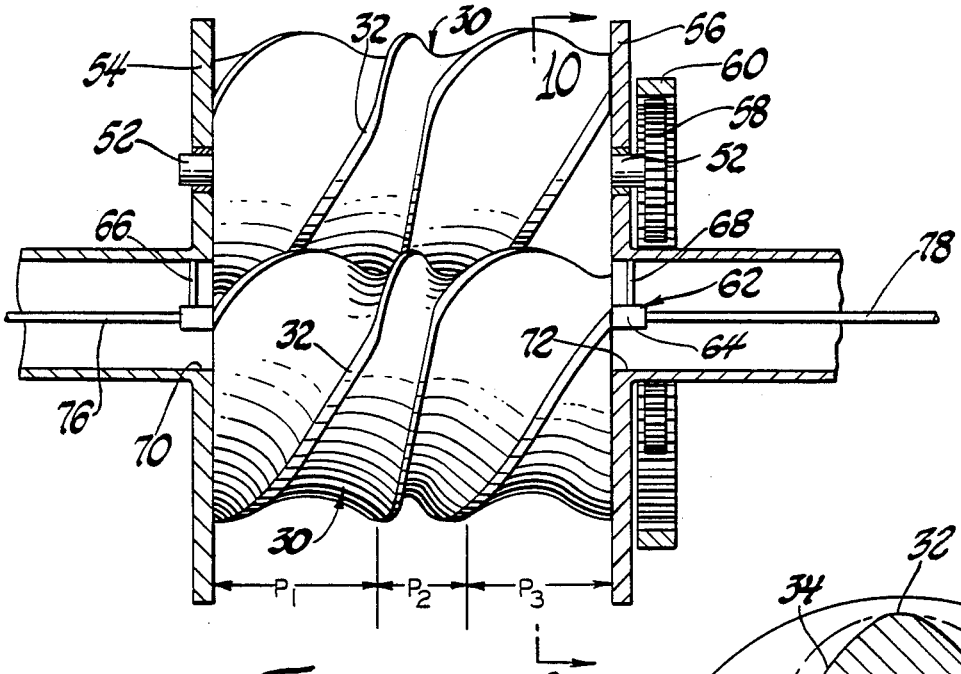

FIG. 8 is a diagrammatic side view with some parts in section of a three helical lobe internal combustion engine according to the present invention.

Figure 9:
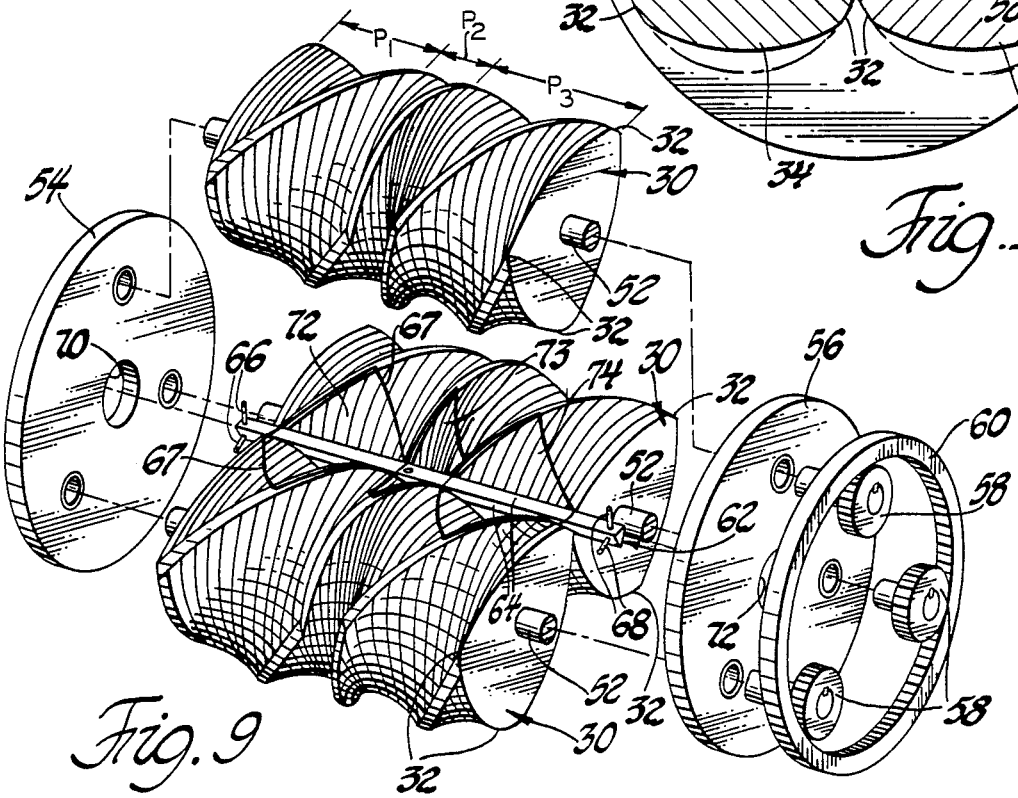

FIG. 9 is an exploded view of the engine in FIG. 8.

Figure 10:
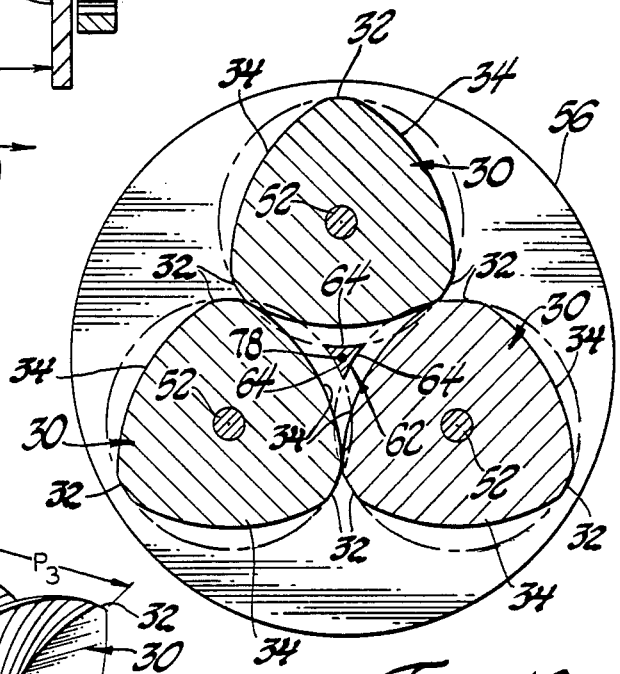

FIG. 10 is a view taken along the line 10—10 in FIG. 8.

Figure 11:
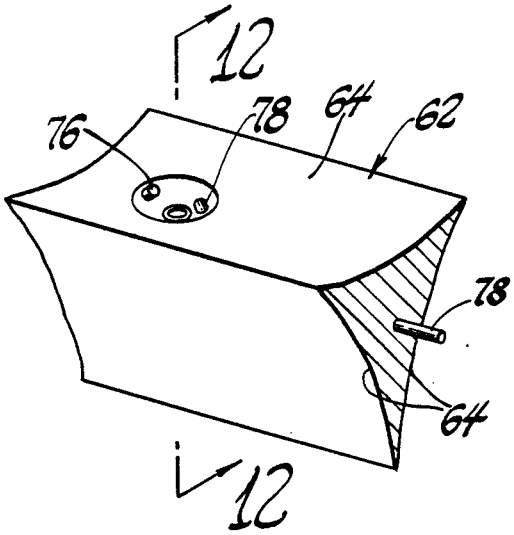

FIG. 11 is an enlarged isometric view of a portion of the stationary tube in the engine in FIG. 8 accessing an ignition system and fuel supply to the working spaces.

Figure 12:
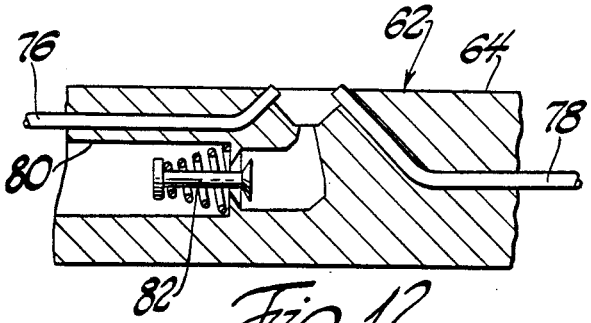

FIG. 12 is a view taken along the line 12—12 in FIG. 11.

Figure 13:
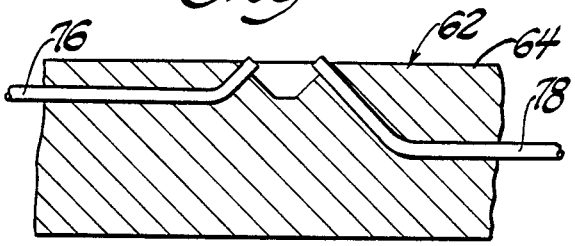

FIG. 13 is a view similar to FIG. 12 but wherein there is omitted the fuel supply.

Figure 14A:
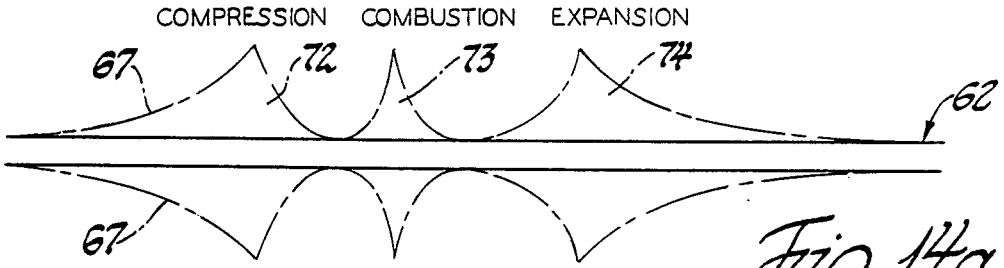
Figure 14B:
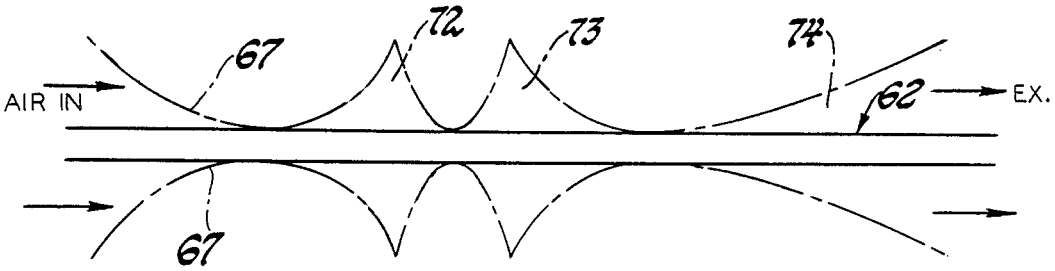

FIGS. 14(*a*) and 14(*b*) are sequential cross-sectional diagrammatic representations of the working spaces in the engine in FIG. 8.

Figure 15A:
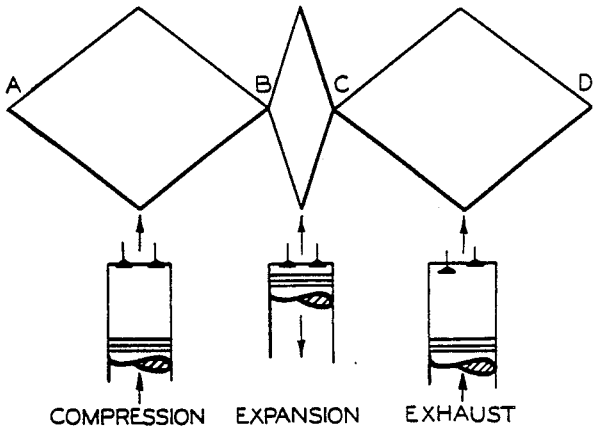
Figure 15B:
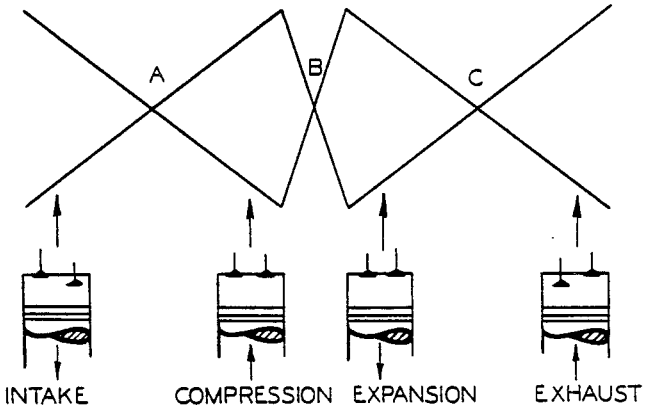

FIGS. 15(*a*) and 15(*b*) are sequential schematic views of the cycle of the engine in FIG. 8 compared with the Otto cycle of a conventional piston engine.

Figure 16:
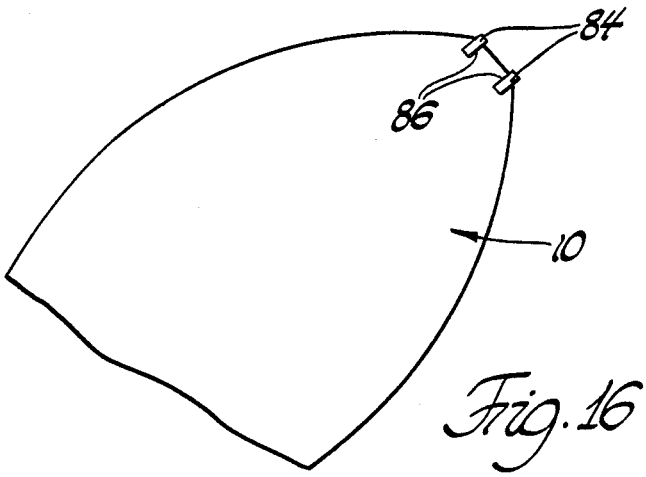

FIG. 16 is an enlarged axial view of one of the lobes in the compressor in FIG. 1 showing the addition of seals.

Figure 2:
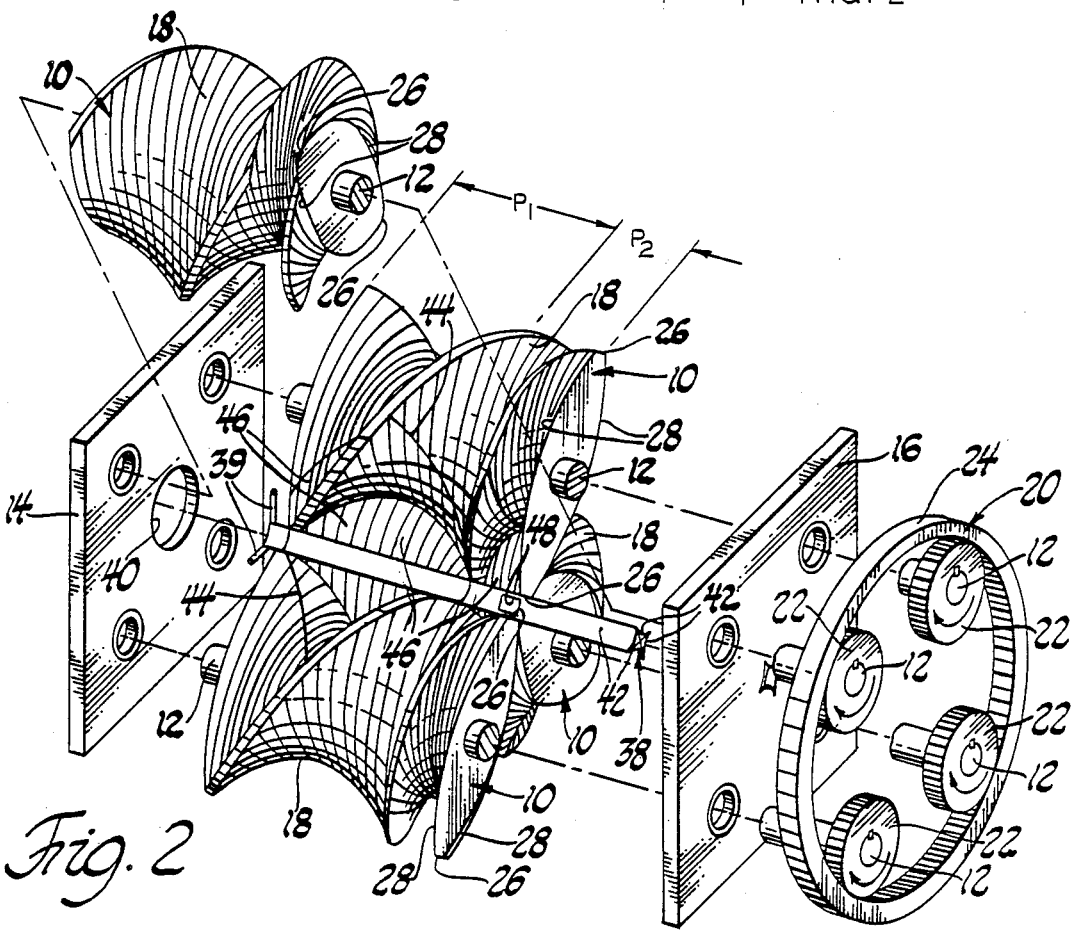
FIG. 2 is an exploded view of the compressor in FIG. 1.
Figure 3:
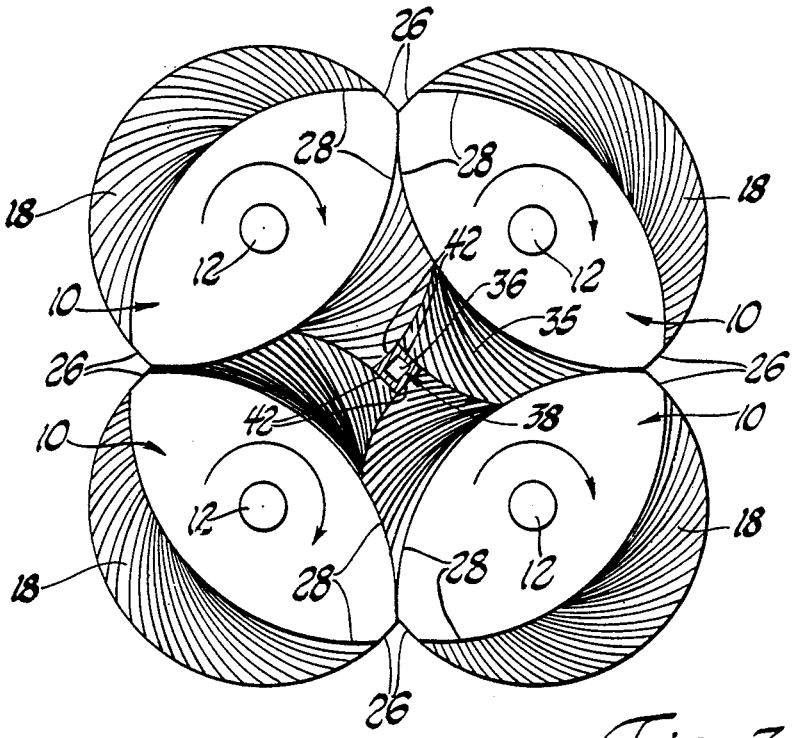
FIG. 3 is a view taken along the line 3—3 in FIG. 1.

Referring to the drawings wherein the same numbers are used throughout the several views to identify the same parts, there is shown an air compressor in FIGS. 1, 2 and 3 comprising four identical rotary intermeshing helical lobes 10 each with a shaft 12 by which the respective lobes are mounted on stationary end plates 14 and 16 for rotation about parallel axes. The lobes have identical helical surfaces 18 with the helical surface of one lobe meshing with those of the two adjoining lobes such that rotation of one would force rotation of the others through their contact and effect self-synchronization but for other reasons as will be explained are forced to rotate in synchronization all in the same direction but out of contact by planetary gearing 20. This gearing comprises identical planet gears 22 connected to one end of the respective shafts 12 and rotatably supported together therewith by the end plate 16. The planet gears mesh with an internal tooth ring gear 24 which in addition to completing the gearing system serves as the input member for the compressor.

Figure 4:
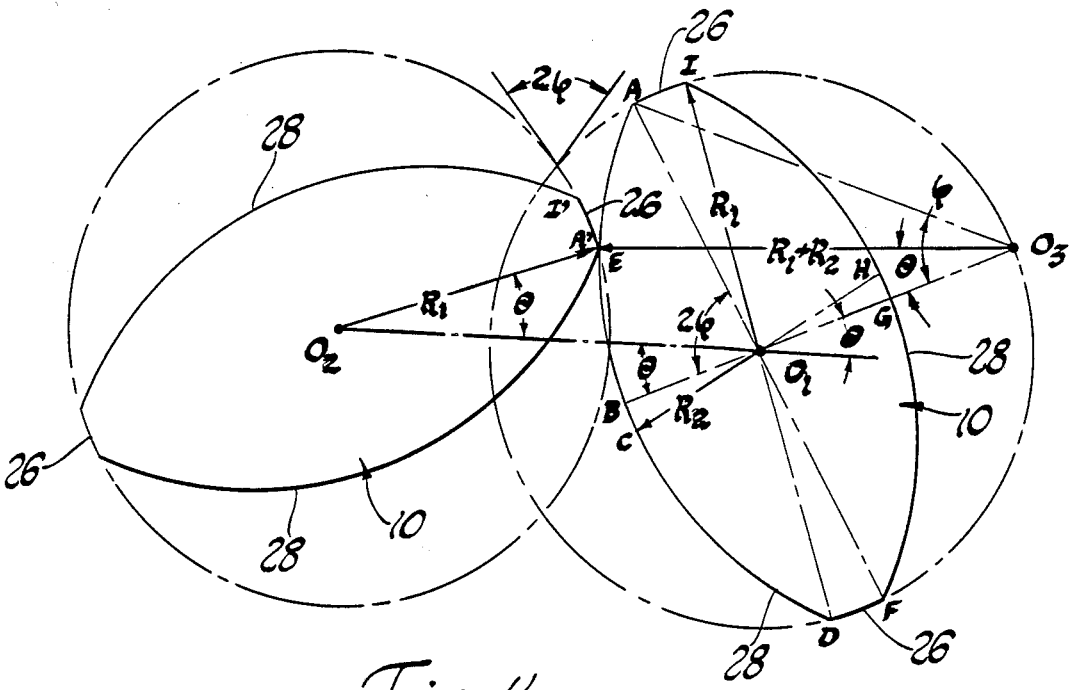
FIG. 4 is a schematic axial view and geometrical explanation of the lobes in FIG. 1.
Figure 5A:
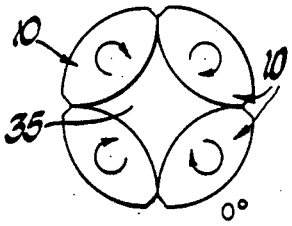
Figure 5B:
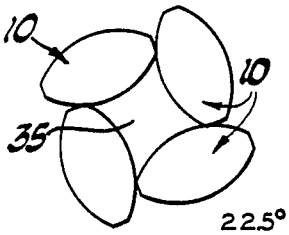
Figure 5C:
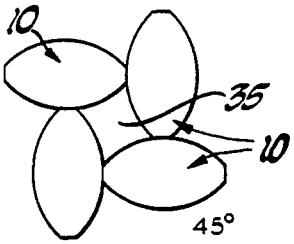
Figure 5D:
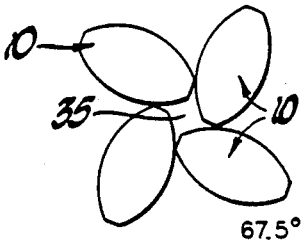
Figure 5E:
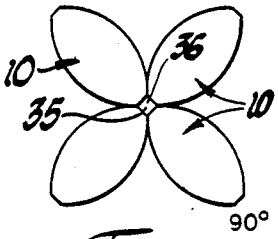
Figure 5F:
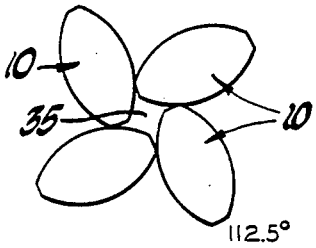
Figure 5G:
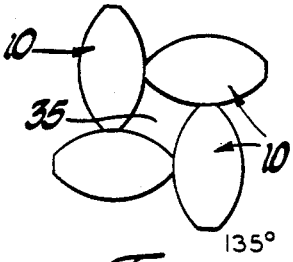
Figure 5H:
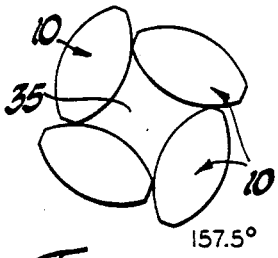
Figure 5I:
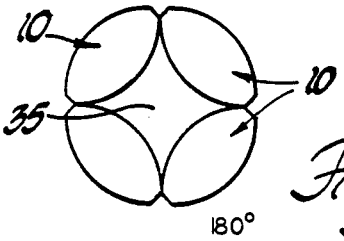

The four lobes 10 of the compressor each have two apexes 26 and two sides 28 and the three lobes 30 of the engine in FIGS. 8–10 later described have three apexes 32 and three sides 34. All elements of the profiles of these lobes (both the apexes and sides) as viewed axially (see FIGS. 1 and 10) are circular arcs and as a result have a continuous close line-to-line line relationship along their helix where they mesh with the other lobes that border or enclose and thereby define a central axially extending opening 35 whose volume continuously varies as the lobes rotate. To help understand this lobe-to-lobe relationship, reference is made to the schematic in FIG. 4 of two of the lobes in FIG. 1 as viewed axially. Considering a point E on a helical line extending about the one lobe axis $0_2$ at a radial distance $R_1$ from the one lobe axis $O_{(2)}$ and an angular distance from the fixed line $O_2$ $O_1$, such point has a corresponding point $O_3$ that forms a parallelogram $O_3EO_2O_1$. When E rotates around $O_2$ with any angular velocity, $O_3$ will rotate about $0_1$ with the same angular velocity and the line $EO_3$ will be parallel and equal to the fixed line $O_2O_1$. This proves that as point E rotates around $O_2$, it also coincides with a point of a circle with center $O_3$ and radius equal to $O_1O_2$ conjointly rotating about $O_1$. Based on the aforeshown kinematic geometry, a variety of profiles can be constructed that will have a continuous point and thus helical line contact when rotating around the centers of the circle as shown, when the intersecting angle $2\phi$ is 0° $2\phi$ 90° and provided all the elements (apexes and sides) of such profiles are circular arcs. In the two sided profile, it is seen that AB is a circular arc with center $0_3$, AI and BC are circular arcs with center $0_1$ and all the arcs have symmetry. However, it was found that only either three or four identical intermeshing helical lobes having two and three sided, double and triple apex profiles respectively all formed of symmetrical circular arcs can be combined and provided with a continuously varying or stepped helical pitch to form continuously variable volume working chambers or spaces internal of the lobes for producing either a compressor or vacuum pump or internal combustion engine as will now be further described first with reference back to the lobes in the compressor in FIG. 1.

These lobes as earlier described with reference to FIG. 3 combine to enclose the axially extending opening or space 35 centrally thereof that is continuously variable in size or volume as the helical lobes rotate with the same angular velocity. The full cycle of this volume variation is shown schematically at progressive 22.5° lobe angle locations in Figures 5(*a–i*) starting at full expansion of the opening in FIG. 5(*a*) at 0° lobe angle and reaching minimum volume at 90° as seen in FIG. 5(*e*) and reassuming maximum volume at 180° as seen in FIG. 5(*i*). And thus there is produced two complete cycles per lobe revolution. The lobes however only form the outer border of this internal opening. To form repetitive three dimensional continuously variable working spaces using this central opening, the central cross sectional zone 36 of this opening that is not swept by the lobes (see FIGS. 3 and 5e) is filled with a stationary cylindrical member 38 extending the length of the lobes. The member 38 extends through an opening 40 in and is fixed by struts 39 to the end plate 14 and has four parallel sides 42 of symmetrical concave circular arc shape conforming to and spaced a small running clearance (air gap) from the apexes 26 of the lobes. As a result, the intermeshing helical surfaces of the lobes cooperate through close apex-to side and apex-to-apex relationships therebetween and also cooperate with the stationary cylindrical member through close apex relationship therewith to form moving boundries 44 defining inwardly as well as outwardly bordered working spaces 46 (see FIGS. 2, 6 and 7). As seen in FIGS. 6 and 7, the boundaries and the working spaces they enclose move in the direction of the arrows on clockwise lobe rotation as viewed in FIG. 2 expanding and then contracting according to the changing or varying helical pitch as will now be further explained. The volume of the working spaces is linearly proportional to the step or pitch of the helix (the length along which the lobe cross sectional profile is rotated 360°) and thus by varying the step either continuously or employing two different constant steps it is possible to provide both expansion and compression to produce a compressor cycle and by varying the step continuously or employing three constant steps it is possible to add another expansion phase to produce an engine cycle as further described later. In the compressor shown, the working cycle is accomplished with two different constant pitches starting with a coarse constant pitch $P_1$ and ending with a fine constant pitch $P_2$ which thus occupy relatively large and small portions respectively of the axial length of the lobes as seen in FIGS. 1, 2, 6 and 7. As the working spaces form one after another at the end plate 14 while expanding, they are open at this end and fluid (either gas or liquid) is admitted thereto through the central opening 40 in this plate. With continued rotation of the lobes, the working spaces become enclosed by the boundaries 44 at the end of expansion occurring at the end of the axial extent of the coarse helical pitch or step $P_1$. Thereafter, the working spaces are then contracted by the fine helical pitch while completed enclosed by these boundaries. The thus compressed fluid near the end of this phase is then exhausted through an exhaust port 48 and central passage 50 in the stationary member 38. The exhaust port 48 is axially located at this end of the lobes adjacent the end plate 16 with the stationary member blocked at the other end and this member with such passage internal thereof continuing through this end plate to exhaust the compressed fluid external of the mechanism.

The engine in FIG. 8 as earlier mentioned has three lobes 30 and like in the compressor these lobes are rotatably supported by shafts 52 on and between two stationary end plates 54 and 56 with their axes parallel. And further like the compressor, the lobes are synchronized by planet gears 58 that are connected to one end of the respective lobe shafts and mesh with a ring gear 60 which in this case serves as an engine output. The lobes 30 with their three-sided cross sectional profile leave, as seen in FIG. 10, an unswept axially extending opening central of the lobes of cross-sectional triangular shape with symmetrical convex sides. This opening is filled in after the manner of the compressor with a stationary cylindrical member 62 having complementary concave sides 64 extending at opposite ends through and fixed by struts 66 and 68 in a central opening 70 and 72 in the respective end plates 54 and 56.

The lobes are formed with three constant pitches or steps $P_1$, $P_2$ and $P_3$ as seen in FIGS. 8 and 9 with the two outer pitches being relatively coarse and either identical or different and the intermediate pitch $P_3$ being a relatively fine pitch or step. As a result, the lobes and the stationary member cooperate after the manner of the compressor arrangement to form moving boundaries 67 and thereby moving working spaces 72, 73 and 74 which sequentially undergo expansion, compression and expansion as shown schematically in FIG. 14 in analogy to FIG. 7 and wherein Figure 14(*b*) illustrates their location after a lobe rotation of 90° from that in FIG. 14(*a*). FIG. 14 also illustrates the additional functions of the stationary member accessing the working spaces in their combustion region. In one version as shown in FIGS. 11 and 12, only air is admitted through the opening 70 in the end plate 54 to the working spaces as they remain open at this end while expanding. To then provide for combustion, the stationary member 62 as shown in FIGS. 11 and 12 internally supports and accesses to the combustion region (1) a ground electrode 76 and a high voltage electrode 78 for sparking by an ignition system of conventional design (not shown) and (2) a fuel passage 80 served by a fuel system of conventional design (not shown), there being provided in the fuel passage a check valve 82 to close the fuel to the combustion region during combustion. The stationary member version shown in FIG. 13 is for when fuel is admitted along with air to the working spaces in which case fuel supply via this member is simply omitted.

FIG. 15 illustrates in a schematic way the resulting engine cycle in relation to the Otto cycle of the conventional piston engine. The working spaces enclosed by the lobes and stationary member at the borders are schematically represented by separation points A, B, C and D with the volume between points A and B equivalent to a bottom dead center piston position at the beginning of compression (end of intake). The volume between B and C is equivalent to the beginning of expansion and the volume between C and D is equivalent to the beginning of exhaust. As seen in FIG. 14(*a*), the working spaces are in the their phase shown in FIG. 9 and therebeneath are seen the corresponding or equivalent positions of the conventional Otto cycle piston engine. After a 60° rotation of the lobes, the working spaces assume the conditions shown in FIG. 14(*b*) with the equivalent positions of the conventional Otto cycle piston engine again appearing underneath. A full cycle is completed after an additional 60° rotation of the lobes and thus there are produced three complete working cycles per lobe revolution.

To minimize leakage across the boundaries or sealing lines, there are various approaches depending on whether the above positive displacement mechanisms are employed as a compressor or vacuum pump or engine. As shown, the air gap is minimized by tight clearances made possible by the above synchronizing gears. This is preferred since the lobes are not in contact and thus can run unlubricated with substantially no friction loss and at very high speeds to take advantage of their fully balanced shape. In addition, such high speeds can also improve the sealing with dynamic effects at the gap. With such a dry-run configuration, there is no need for any external housing other than for structure rigidity. Moreover, the outer side of the lobes are then exposed to the ambient air and can be cooled convectively by the air flow generated fan like by the helix. Alternatively, a liquid seal in the case of the compressor may be introduced internally or externally to form a film at the running clearance or air gap between the lobes to dynamically enhance their sealing. Moreover, the lubrication abilities may be such as to allow the lobes to run in contact and thereby be self-synchronized without the above synchronizing gears. However, an external housing may then be required to contain the lubricant. A further alternative is to provide solid seals 84 in slots 86 along the edges of the lobes where their sides and apexes meet as shown in FIG. 16.

It will be further appreciated that a three lobe arrangement can also serve to form a compressor or vacuum pump and that a four lobe arrangement can also serve to form an engine by subtracting and adding a helical step from or to the respective three and four lobe arrangements described above. In either event, it is only a three or four helical lobe arrangement which in cooperation with an internal stationary member that will completely define an internal volume positive displacement device. Moreover, it will be understood that while only constant steps or pitches have been shown with the helical lobes for both the compressor (pump) and engine, a continuously varying pitch varying from coarse-to-fine and coarse-to-fine-to-coarse, respectively, can also be employed with similar results.

The above described preferred embodiments are illustrative of the invention which may be modified within the scope of the appended claims.

The embodiments of the invention in which an exclusive property or privilege is claimed are defined as follows:

1. A positive displacement rotary mechanism comprising three essentially identical rotary helical intermeshing lobes with parallel axes and identical helical surfaces extending between axially spaced ends thereof, a three-sided stationary cylindrical member extending centrally of said lobes and parallel to said axes, said helical surfaces having a varying pitch and a cross sectional profile as viewed axially having at least two convex circular apexes joined by convex circular sides such that said helical surfaces cooperate through close apex-to-side and apex-to-apex relationships therebetween and also cooperate with the sides of said cylindrical member through close apex relationship therewith to define a repetitive working space internal of said lobes having boundaries along and between said lobes and along and between said lobes and said cylindrical member which boundaries move on rotation of said lobes to effect expansion and contraction of said working space while repetitively moving same from one of said ends of said lobes toward the other end, and said stationary member having an exhaust passage extending therethrough with an opening to said working space.

2. A positive displacement rotary mechanism comprising three essentially identical rotary helical intermeshing lobes with parallel axes and identical helical surfaces extending between axially spaced ends thereof, a three-sided stationary cylindrical member extending centrally of said lobes and parallel to said axes, said helical surfaces having a varying pitch and a cross sectional profile as viewed axially having at least two convex circular apexes joined by convex circular sides such that said helical surfaces cooperate through close apex-to-side and apex-to-apex relationships therebetween and also cooperate with the sides of said cylindrical member through close apex relationship therewith to define a repetitive working space internal of said lobes having boundaries along and between said lobes and along and between said lobes and said cylindrical member which boundaries move on rotation of said lobes to effect expansion and contraction of said working space while repetitively moving same from one of said ends of said lobes toward the other end, and said stationary member having a fuel supply passage open to said working space.

* * * * *